US005377602A

United States Patent [19]

Keogh

[11] Patent Number: 5,377,602

[45] Date of Patent: Jan. 3, 1995

[54] INSTALLATION OF SAFES

[76] Inventor: Joseph P. Keogh, 33 Lenton Parade, Waterloo, NSW 2017, Australia

[21] Appl. No.: 930,540

[22] PCT Filed: Mar. 26, 1991

[86] PCT No.: PCT/AU91/00114

§ 371 Date: Nov. 19, 1992

§ 102(e) Date: Nov. 19, 1992

[87] PCT Pub. No.: WO91/14841

PCT Pub. Date: Oct. 3, 1991

[30] Foreign Application Priority Data

Mar. 26, 1990 [AU] Australia ..... PJ9311
Dec. 24, 1990 [AU] Australia ..... PK4044

[51] Int. Cl.[6] ..... E05G 1/00; E05G 21/00; E04B 1/38

[52] U.S. Cl. ..... 109/51; 52/698; 52/745.21

[58] Field of Search ..... 52/21, 20, 19, 220.5, 52/220.8, 699, 700, 701, 745.1, 698, 745.21; 109/50, 51, 52; 174/48, 50

[56] References Cited

U.S. PATENT DOCUMENTS

| | | | |
|---|---|---|---|
| 702,883 | 6/1902 | Peckham | 109/51 |
| 937,215 | 10/1909 | Kelonge | 109/51 |
| 1,607,361 | 11/1926 | Poland et al. | 109/51 |
| 3,394,509 | 7/1968 | Mckinley | 52/220.5 |
| 3,517,906 | 6/1970 | Blonde . | |
| 4,176,440 | 12/1979 | Lichter . | |
| 4,925,337 | 5/1990 | Spiess et al. | 52/20 |

*Primary Examiner*—Michael Safavi
*Attorney, Agent, or Firm*—Richard C. Litman

[57] ABSTRACT

A method and device for the removable installation of safes (7,25,31), strongboxes and the like by casting a void in concrete and fastening the same (7,25,31) or the like therein. The device comprising a formwork member (1) having at least one anchorage means (3,23,33) fitted thereto. The anchorage means (3,23,33) provided such that a safe (7,25,31) can be secured to it.

8 Claims, 6 Drawing Sheets

INSTALLATION OF SAFES

TECHNICAL FIELD

The present invention relates to a method of installing in-floor safes. Whilst the invention is according to one embodiment directed towards and is primarily to be described with reference to a method for installing in-floor safes, it is anticipated that the method is suitable for use with portable strong boxes and the like and may be used domestically or in commercial and office situations.

BACKGROUND

Typically in-floor safes are cast permanently in concrete and become part of the building or structure. Another known method of installing in-floor safes is to cut into a concrete base and create the necessary void into which the in-floor safe is concreted. Certain disadvantages are associated with both these methods. Firstly, the permanently casting in of a safe generally results in the owner having to abandon a valuable safe when moving premises. Secondly, the labour and machinery involved in the cutting of a void into a concrete base makes this form of installation expensive.

DISCLOSURE OF INVENTION

The fundamental purpose of the present invention is to provide a device and method for the removable installation of infloor or in-wall safes by casting a void in concrete and fastening the safe therein.

In one broad form the present invention comprises a formwork device for the casting of a void in concrete, said void adapted for the removable installation of a safe or strongbox, said formwork device comprising:

a formwork member having at least one anchorage means secured thereto or forming part thereof, wherein when concrete is cast around said formwork device said anchorage means is embedded in said concrete, said safe or strongbox adapted to be secured within said void by fastening to said anchorage means.

In another form the present invention is a method of removably installing a safe or strongbox in concrete, said method comprising the steps of:

a) positioning a formwork device comprising a formwork member having at least one anchorage means secured thereto or forming part thereof;

b) casting concrete around said formwork device and embedding said anchorage means in said concrete;

c) positioning said safe or strongbox in a void created by said formwork member and securing said safe to said anchorage means.

In a further form the invention comprises a formwork device for the casting of a void in concrete, said void adapted for the removable installation of a safe or strongbox, said formwork device comprising:

a formwork member with a hollow interior and one open end and at least one portion with a cavity protruding therefrom, wherein an anchorage means is placed in said cavity of said at least one portion and said formwork member is adapted to receive said safe or strongbox and be fastened to said anchorage means by at least one securing means which is positioned in the interior of the safe or strongbox and protrudes therethrough to engage said anchorage means.

In an even further form the invention comprises a method of removably installing a safe in concrete, said method comprising the steps of:

(a) positioning a formwork device comprising a formwork member with a hollow interior and one open end and at least one portion with a cavity protruding therefrom;

(b) casting concrete around said formwork device embedding same;

(c) placing at least one anchorage means in said cavity;

(d) positioning said safe in said formwork member and securing said safe to said ancorage means.

The invention will now be described by way of a non-limiting example with reference to the following drawings.

MODE FOR CARRYING OUT INVENTION

Figure 1:
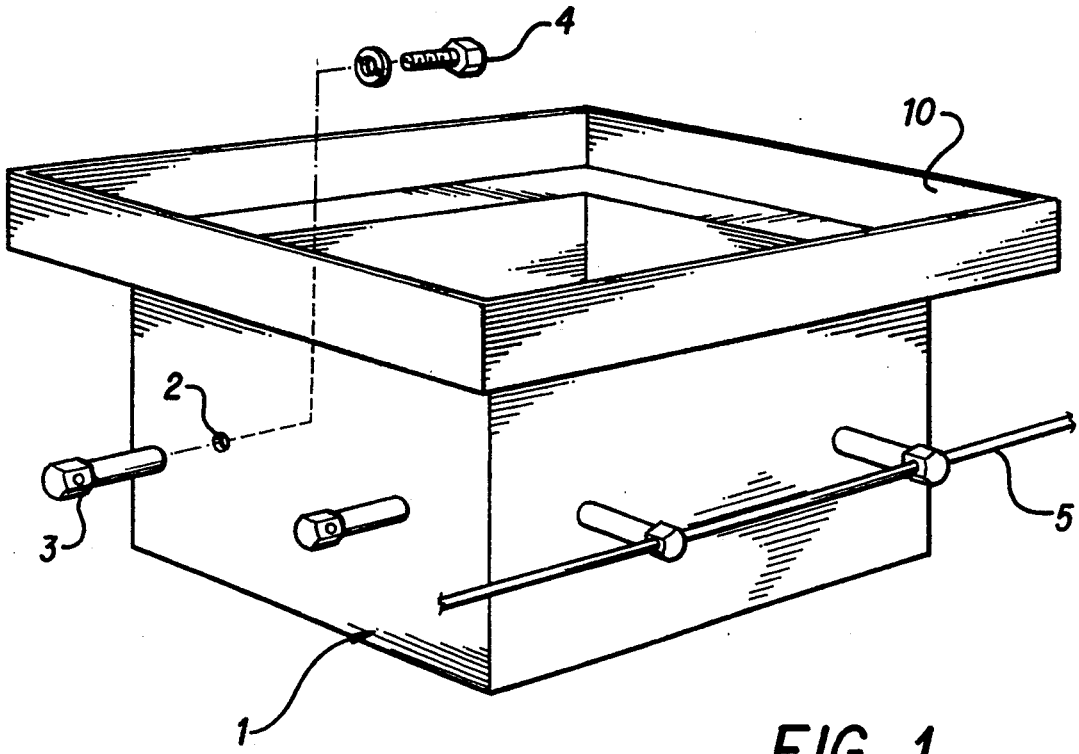
FIG. 1 illustrates a perspective view of one embodiment of the formwork device of the present invention.

In one embodiment of the present invention the formwork member 1 is a rectangular box like member as depicted in FIG. 1. The formwork device 1 has a plurality of holes 2 which allow concrete inserts 3 or the like to be fastened to the outer surface of the formwork device by means of threaded fasteners 4. The concrete inserts 3 are adapted to engage concrete reinforcing rods 5 or the like.

Figure 2:
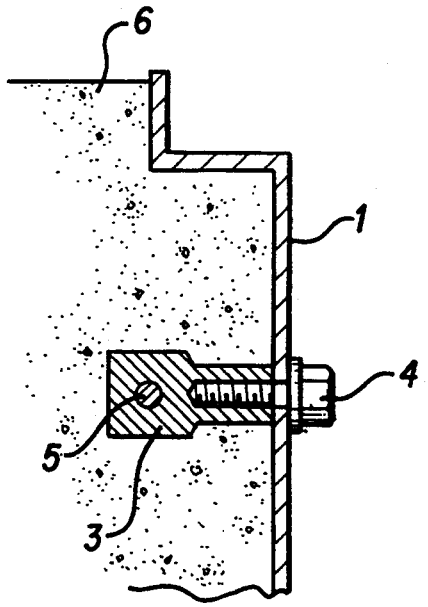
FIG. 2 illustrates a partial cross sectional view of the formwork device of FIG. 1 and a concrete insert set in concrete.
Figure 3:
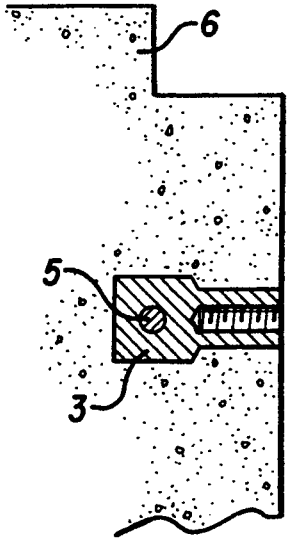
FIG. 3 illustrates the concrete insert as depicted in FIG. 2 with the formwork device removed.

The formwork member 1 is adapted for casting a void in a concrete floor at the time of constructing the concrete floor. The word concrete used throughout the specification is to be understood to include as meaning any mouldable building material which may easily be moulded around the formwork device and is then able to harden. In use the formwork member 1 having the concrete inserts 3 attached by means of the threaded fasteners 4, is placed in position, the reinforcing rods 5 or the like attached to the concrete inserts 3 prior to the casting of the concrete floor. Once the concrete floor 6 is set, the threaded fasteners 4 (see the one shown in FIG. 2) may be removed from the concrete inserts 3. This then allows the formwork device 1 to be removed leaving a void adapted to receive a safe or the like. As depicted in FIG. 3 the concrete inserts 3 are set in the concrete floor 6 and remain in place when the formwork member 1 is removed.

Figure 4:
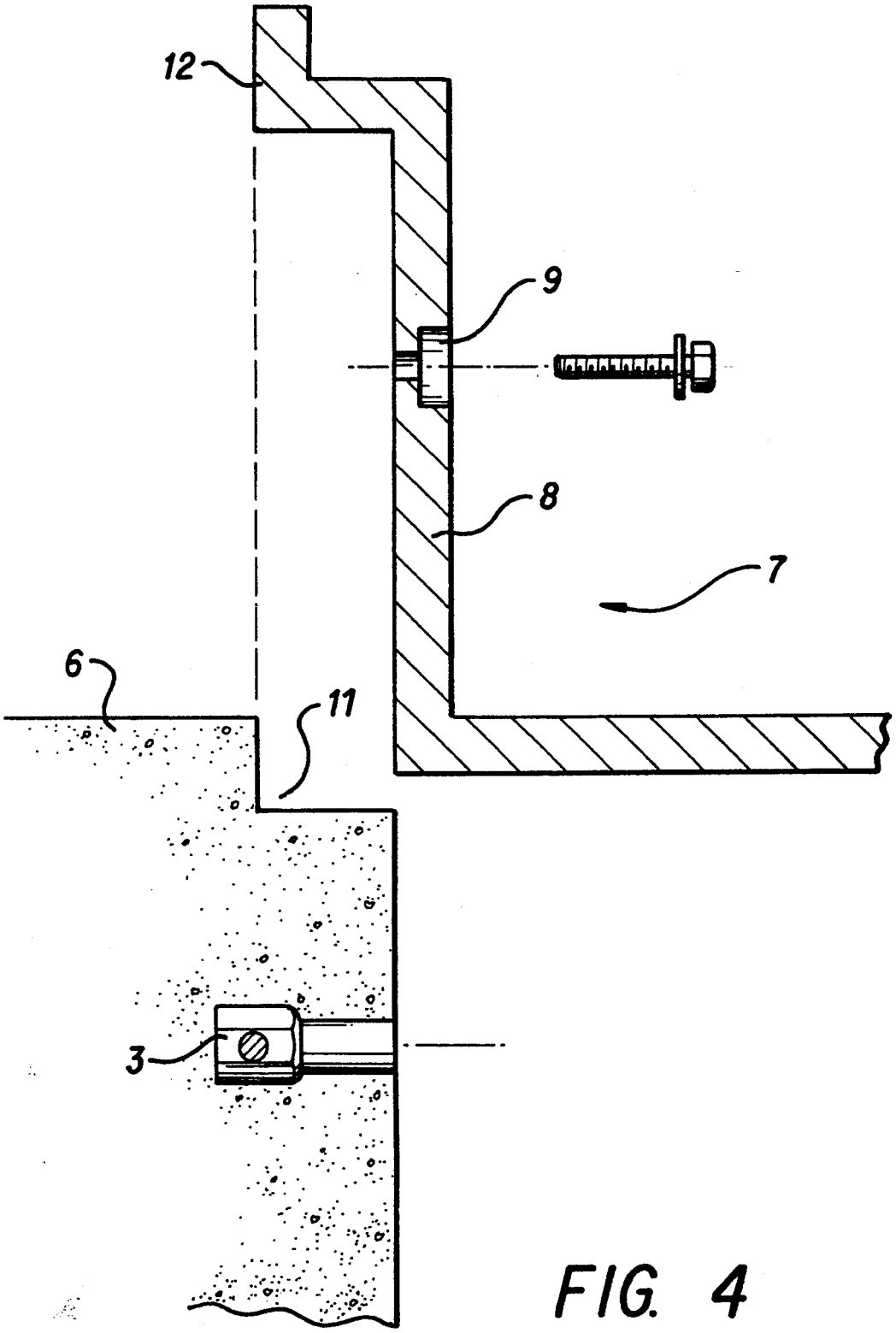
FIG. 4 illustrates a partial cross sectional view of a safe or the like being fitted to the void created by the formwork device.

The formwork member 1 is adapted to cast the concrete inserts 3 in a position corresponding to the openings 9 in the wall 8 of safe 7 or the like, as shown in FIG. 4. The safe 7 or the like may be installed and secured from the inside into the correctly located concrete inserts 3.

In the abovementioned embodiment a collar 10 (see FIG. 1), runs around the periphery of the upper portion of the formwork member 1. The collar 10 allows for a seat region 11 to be cast into the concrete 6. A flange 12 on the upper portion of the safe 7 is then able to sit within the region 11. The flange 12 and region 11 are provided to hinder access to the walls of the safe 7 and to the concrete inserts 3 once the safe 7 is in place.

The formwork member 1 of the abovementioned device may be made of various suitable materials such as steel, aluminium, plastics, treated cardboard and the like. Additionally the formwork device 1 need not be rectangular and may be of a different shape and size to accommodate different styles of safe e.g. cylindrical, hexagonal etc.

In a not shown embodiment the formwork member 1 of FIG. 1 may be left in place once the concrete floor 6 is set and the threaded fasteners 4 are removed from the concrete inserts 3. The safe 7 being adapted to be placed into the formwork member 1 and fastened to the concrete inserts 3. The formwork member 1 acting as liner between the concrete floor 6 and the safe 7 thereby providing a barrier hindering the migration of moisture through the concrete to the safe. In such an embodiment the concrete inserts 3 may or may not be permanently attached to the formwork member.

In further not shown embodiments the concrete inserts 3 of the above embodiments may be replaced by other anchoring means, such as nuts, threaded plates and the like, which may be attached or are provided with reinforcing means for anchoring to the concrete floor 6.

Figure 5:
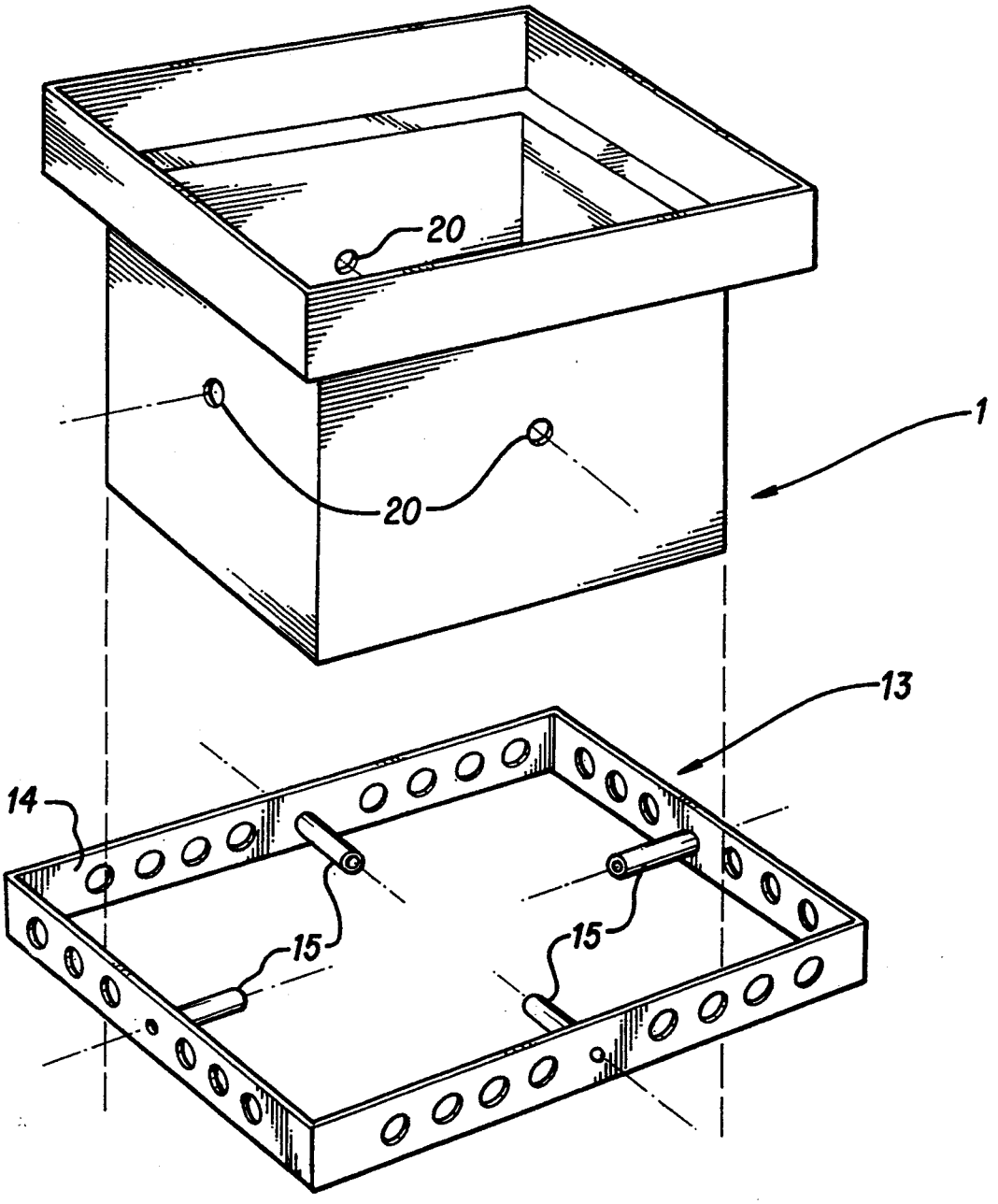
FIG. 5 illustrates a perspective view of a second embodiment of the formwork device of the present invention.

In a second embodiment as shown in FIG. 5 the formwork member 1 may alternatively be attached to an anchorage means 13 comprising a perforated metal band 14 with threaded tubes 15 welded to the inner surface of the metal band 14. The anchorage means 13 is configured such that it may be positioned around the formwork member 1 and fastened through holes 20 by threaded fasteners which connect into threaded tubes 15. The free end of the threaded tubes 15 abut the outer surface of the formwork member 1 in this configuration.

In use the formwork member 1 with the anchorage means 13 is placed in position and reinforcing rods or the like may be passed through the perforations in the perforated metal band 14 or connected thereto, thereby providing anchorage to a reinforcing matrix prior to casting of the concrete floor. Additionally the perforated metal band assists in the levelling of the formwork member 1 at the time of positioning and also stiffens the formwork member 1 in order to minimize distortion during the pouring of concrete. Once the concrete floor is cast the fasteners may be removed from the threaded tubes 15. A safe (not shown) may then be fitted within the void created and removably secured in place by fasteners. As in the first embodiment the formwork member 1 may be removed before the safe is placed in the void or alternatively be left in place as a liner between the concrete and the safe.

Figure 6:
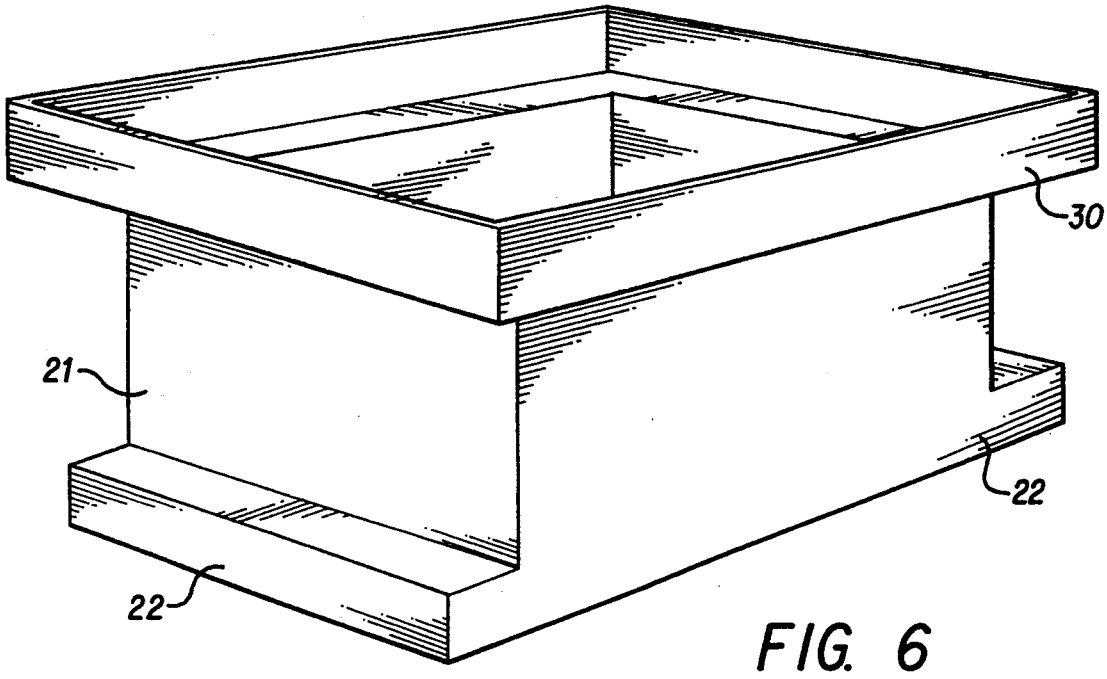
FIG. 6 illustrates a perspective view of a third embodiment of the formwork device of the present invention.

A third embodiment of the present invention is shown in FIGS. 6 to 9. The formwork member 21 as shown in FIG. 6 is a rectangular box like member. The formwork member 21 has a collar 30 adapted to accomodate the collar (or flange) of a safe 25, see FIG. 9. The formwork member 21 having two protrusions 22 at its lower portion each protrusion forming a cavity 26.

Figure 8:
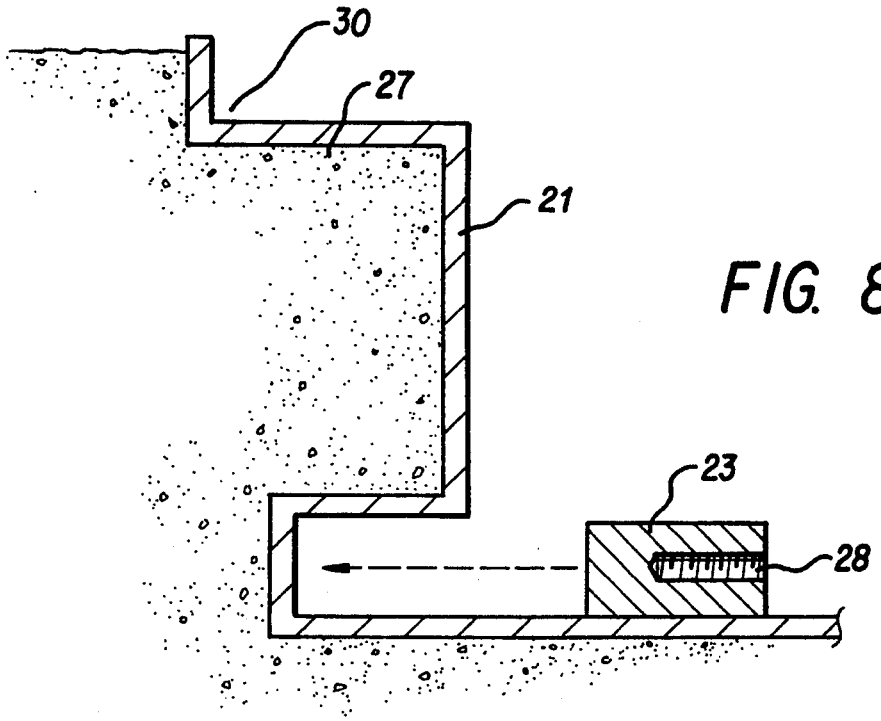
FIG. 8 illustrates a partial cross sectional view of the formwork device of FIGS. 6 and 7 with anchorage means being fitted.

With reference to FIG. 8, anchors 23, preferably of steel or metal alloy are adapted to fit cavity 26. The anchors 23 are provided with a fastener thread 28.

The method of installing the safe of the third embodiment is as follows.

The formwork member 1 is cast in concrete 27 so that the top of collar 30 is substantially flush with the top of the intended concrete floor slab.

Figure 7:
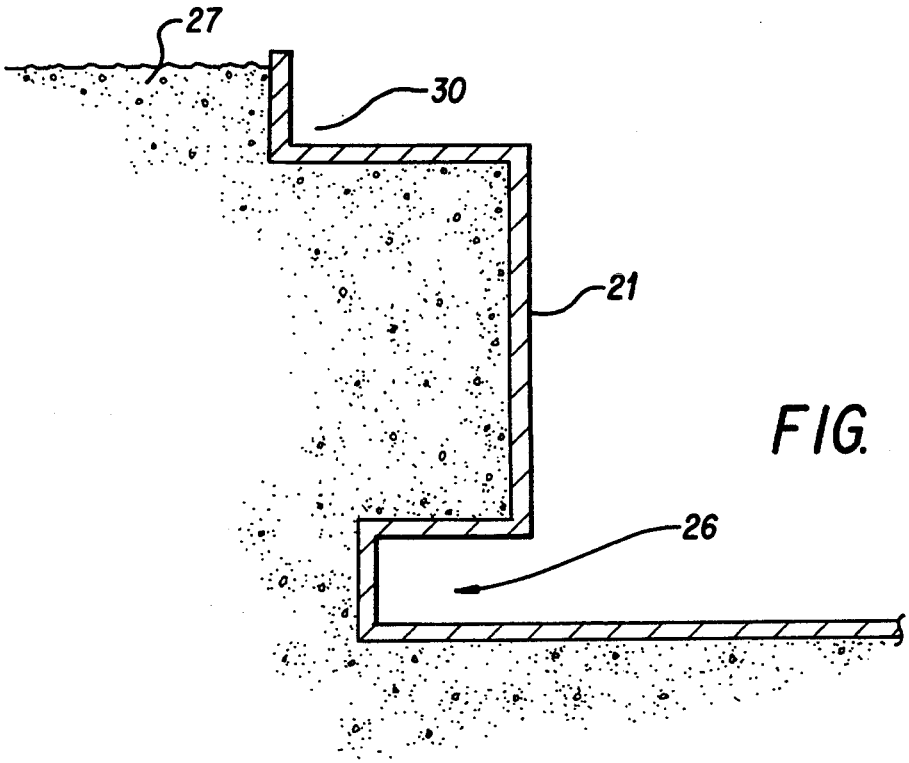
FIG. 7 illustrates a partial cross sectional view of the formwork device of FIG. 6 set in concrete.

When concrete 27 has set or at any time later the steel anchors 23 may be slid into the cavity 26, see FIGS. 7 and 8. The steel anchors 23 may in fact be positioned in the cavity 26 before the formwork member is positioned or the concrete is cast, and may also be incorporated in the formwork member at the time of its manufacture. The safe 25 which is adapted to fit into the void of the formwork member 21 is lowered into the void and fastened by fasteners 29 to anchors 23, see FIG. 9. This means that the safe 25 may easily be secured whilst enabling later removal if necessary.

The formwork member 21 like that of formwork member 1 of the first and second embodiments of the invention may be made of various suitable materials, and need not be rectangular and may be of different shape and size to accomodate different styles e.g. cylindrical, hexagonal etc. Additionally, the protrusions 22 may vary in configuration, positioning and number and may also be just one singular protrusion around the periphery of the formwork member.

Figure 9:
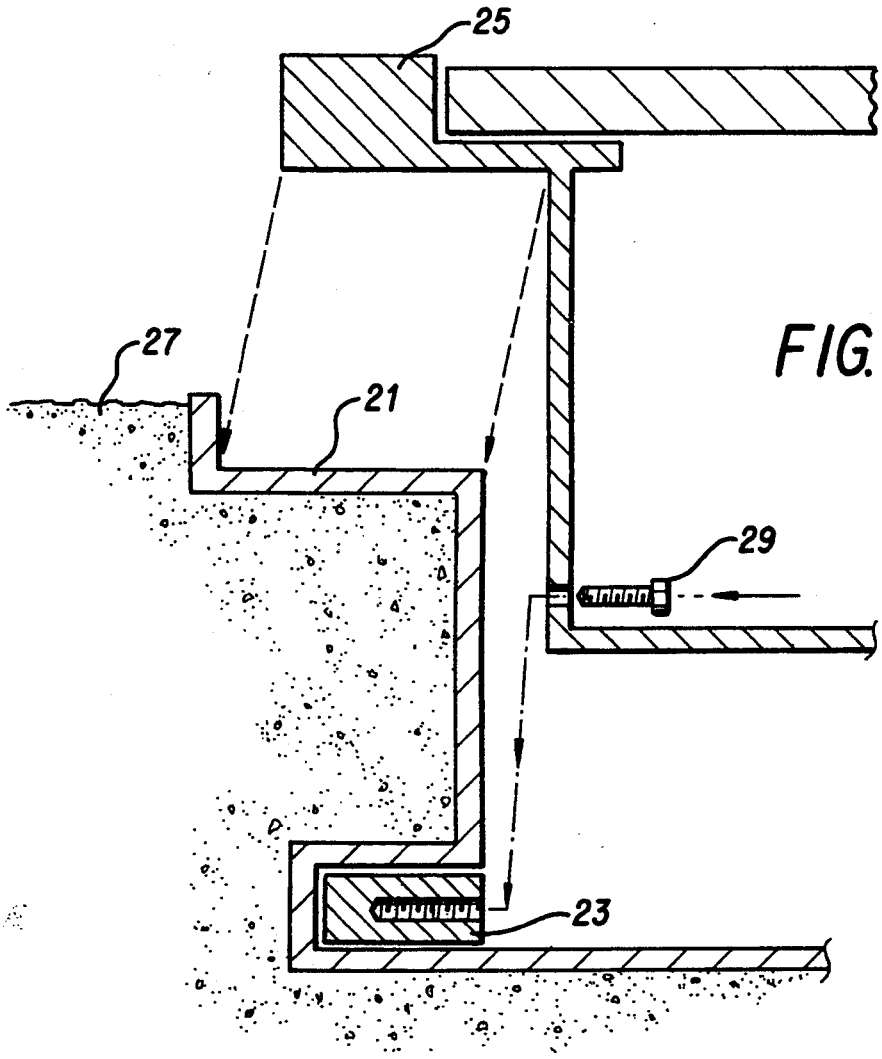
FIG. 9 illustrates a partial cross sectional view of the formwork device of FIG. 6, 7 and 8 and the attachment of a safe thereto.
Figure 10:
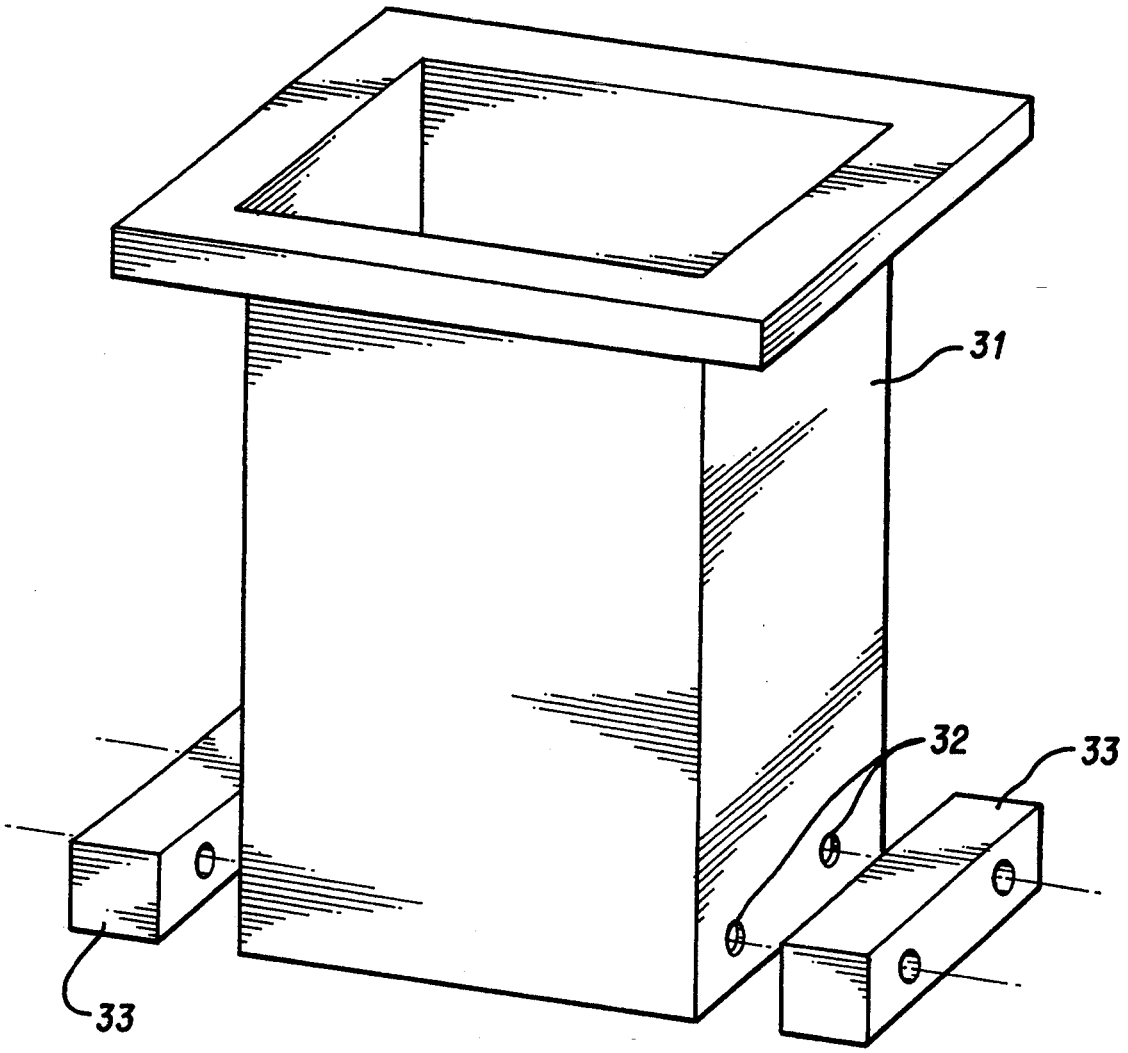
FIG. 10 illustrates an embodiment of a safe or strongbox suitable for use with a formwork device similar to that of FIG. 6. (Safe not shown to same scale as the formwork device of FIG. 7).

Whilst FIG. 9 depicts a safe 25 of the third embodiment, FIG. 10 depicts another safe or strongbox structure 31 (without its door or closure means) which could be installed in a void created by a formwork member similar to that of the third embodiment. The safe or strongbox structure would be fastened to anchors 33 in a like manner to that of the third embodiment. The fasteners would be passed through holes 32 and secured to anchors 33.

In further not shown embodiments the fasteners of the first, second and third embodiments may be replaced by quick release clips, locks or the like, adapted to engage the concrete inserts, anchors, anchorage means or the like. In such an embodiment the formwork members could be adapted for the casting of a void for use with portable cashboxes or strongboxes. The quick release clips, locks or the like allowing for the ease of removal of the cashbox (from the inside).

The formwork device and method of the present invention enables a void to be formed in a concrete floor and allows for installation of a safe or the like once the concrete is set. However, the void once formed may be covered by a lid and carpet or the like layed over it. The void being formed for possible later use. This is particularly useful for commercial or office lease situations where there is a turnover of tenants.

The device and method of the present invention therefore provides an improved means of installing in-floor safes. The invention allows for the removable securing of the safe such that an owner may remove a valuable safe when leaving the premises. Additionally the present invention provides a means of removably securing portable cashboxes/strongboxes or the like to an in-floor anchorage point.

It should be obvious to persons skilled in the art that numerous variations and modifications could be made to the method and device of the present invention as described and with reference to the drawings without departing from the overall scope or spirit of the invention.

I claim:

1. A safe installation including a safe and formwork with said formwork cast within a concrete structure, said form work providing a void therein within which said safe is installed, said formwork having a surrounding side wall and a base wall defining said void and including an open end, said side wall including at least one portion thereof protruding outwardly from said side wall proximate to said base wall to provide a cavity protruding outwardly from said side wall, anchorage means disposed within said outwardly protruding cavity, securing means protruding through said safe engaged with said anchorage means and retaining said safe within said formwork in said concrete structure.

2. A safe installation as claimed in claim 1 wherein said securing means is a male threaded connector and said anchorage means is provided with at least one female threaded opening to receiving said male threaded connector.

3. The safe installation as claimed in claim 1, wherein said formwork member includes a collar at said open end forming a seat at the opening of the void and accommodating a flange means surrounding the safe.

4. A method of removably installing a safe in concrete, said method comprising the steps of:

(a) positioning a formwork device comprising a formwork member having a surrounding side wall and a base wall to define a hollow interior and an open end, wherein at least one portion of said side wall having a cavity protruding outwardly from said side wall proximate to said base wall;

(b) casting concrete around said formwork device embedding same;

(c) placing at least one anchorage means in said cavity;

(d) positioning said safe in said formwork member; and (e) securing said safe to said anchorage means by at least one securing means positioned in the interior of the safe, said securing means protruding through said safe to engage said anchorage means.

5. A method of removably installing a safe in concrete as claimed in claim 4 wherein step (c) is attended to before step (a) or step (b).

6. A method of removably installing a safe as claimed in claims 4 wherein at step (d) the safe is fastened to said anchorage means by at least one securing means which is positioned in the interior of the safe and protrudes therethrough to engage the anchorage means.

7. A method of removably installing a safe as claimed in claim 6 wherein said securing means are male threaded fasteners adapted to engage at least one complimentary female threaded opening in said anchorage means.

8. A method of removably installing a safe as claimed in claim 4 wherein said formwork member has a collar at or near said open end in order to provide a seat to accomodate a flange means surrounding the safe.

* * * * *